United States Patent [19]

Blakeman

[11] Patent Number: 4,867,441

[45] Date of Patent: Sep. 19, 1989

[54] CYCLIST AID FOR LEG AMPUTEES

[76] Inventor: Walter W. Blakeman, Rte. 1, Box 630-F, Gulf Breeze, Fla. 32561

[21] Appl. No.: 235,053

[22] Filed: Aug. 23, 1988

[51] Int. Cl.[4] ..... A45B 1/00; A63B 21/00; G05G 1/14; A47D 13/04

[52] U.S. Cl. ..... 272/73; 74/594.4; 74/562; 135/65; 297/5

[58] Field of Search ..... 272/73, 143, 144, 145; 297/5; 280/289, 289 WC, 294; 135/65, 84, 77–79; 74/594.4, 594.6, 594.7, 562, 564; 128/25 R, 25 B

[56] References Cited

U.S. PATENT DOCUMENTS 2,641,249 6/1953 Brockman ..... 272/73
3,696,826 10/1972 Gruzalski ..... 135/65
4,451,080 5/1984 Nix ..... 297/5
4,741,527 5/1988 Nestegard ..... 272/73

FOREIGN PATENT DOCUMENTS 2814756 10/1979 Fed. Rep. of Germany ..... 272/73

*Primary Examiner*—S. R. Crow
*Attorney, Agent, or Firm*—William David Kiesel; Robert C. Tucker; Timothy J. Monahan

[57] ABSTRACT

An apparatus to allow a leg amputee having only a thigh stump to ride a bicycle comprising a height adjustable shaft assembly having a means rotatably attached to the lower end of the shaft assembly and attachable to the pedal of the bicycle and further having a thigh stump support assembly for attaching the thigh stump to the shaft assembly.

11 Claims, 3 Drawing Sheets

CYCLIST AID FOR LEG AMPUTEES

BACKGROUND OF THE INVENTION

1. Field of the Invention.

This invention relates to apparatus to assist leg amputees having only a thigh stump in riding a conventional or exercise bicycle.

2. Prior Art.

One of the major problems facing above knee and below knee leg amputees is exercising the muscles in the remaining part of the leg. This is particularly true wherein only a thigh stump remains. The present practice of the industry is to utilize a weight and pulley assembly that attachs to the thigh stump and which the amputee lifts with his thigh stump. Although such an assembly does provide the exercise necessary for the thigh muscles, it does not provide cardiovascular exercise of any appreciable amount. Another difficulty is the uncomfortableness of prior art exercising devices. Still another difficulty is the disinterest the amputee develops because of the boredom in using the device.

One example of prior art devices for reducing leg spasms utilized for paraplegics and the like is disclosed in U.S. Pat. No. 4,402,502 entitled "Exerciser for Disabled Persons" issued to Gilbert E. Peters on Sept. 6, 1983. However, such a device is not designed for use by amputees to exercise thigh muscles.

SUMMARY OF THE INVENTION

Therefore it is an object of this invention to provide a device which can be attached to a bicycle or stationary exercise bicycle and to the amputee's thigh stump to allow the amputee to operate the bicycle.

Another object of this invention is to provide a device useful in exercising the thigh muscles of a leg amuputee.

Still another object of this invention is to provide a device useful in exercising the thigh muscles of a leg amuputee while in the privacy of their home.

Other objects and advantages of this invention will become apparent from the ensuing descriptions of the invention.

Accordingly, an apparatus to be used by a leg amputee having only a thigh stump in riding an exercise bicycle having foot pedals is disclosed comprising a shaft with a means connected at its lower end for attaching to one of the foot pedals and at its upper end having separated support members extending upward, a flexible thigh stump support means pivotly attached to each support member and being of a length sufficient to wrap around the thigh stump, and fastening means attached to the ends of the thigh stump support means to operatively hold the flexible thigh stump support means firmly against the thigh stump.

PREFERRED EMBODIMENTS OF THE INVENTION

Figure 1:
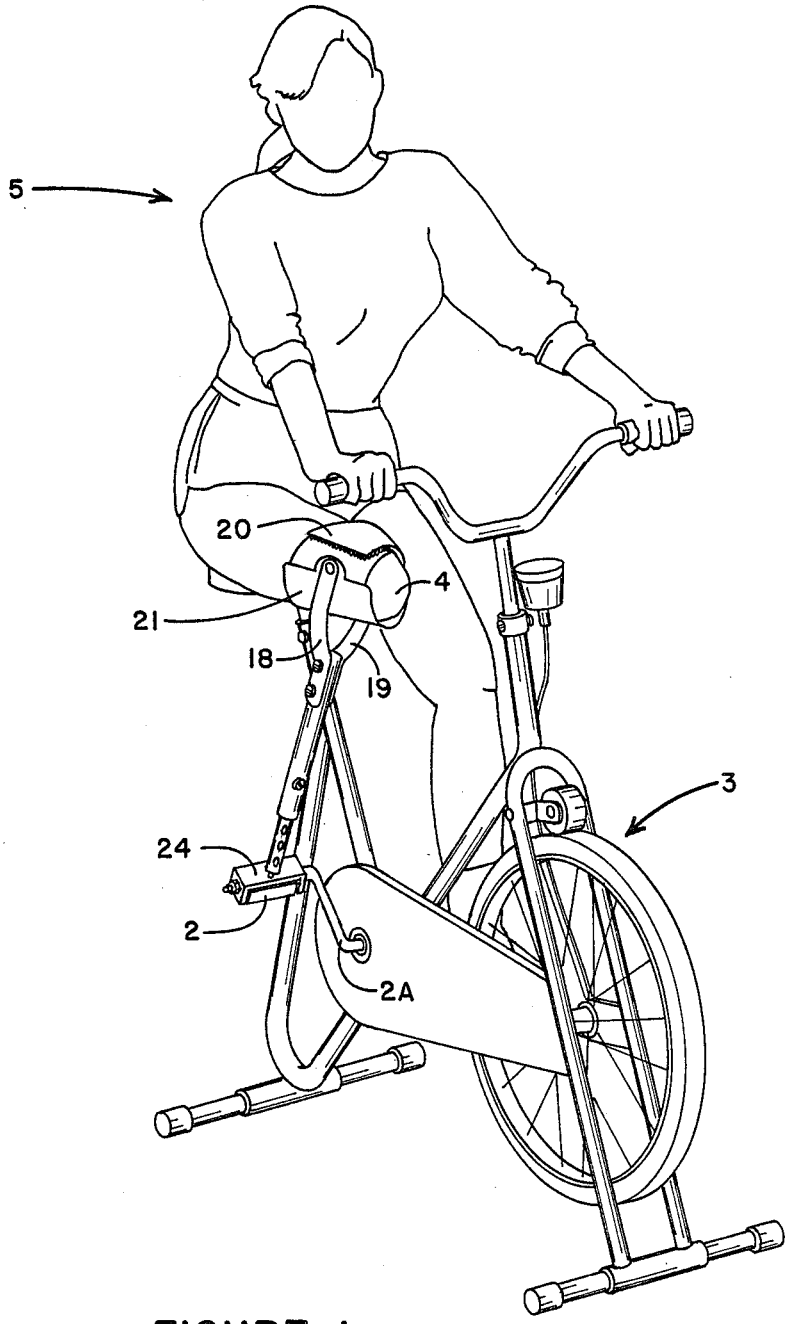
FIG. 1 is a three-fourths perspective view of the invention attached to the thigh stump of a leg amputee and a stationary exercise bicycle.

Referring now to FIG. 1, the amputee cyclist aid, denoted generally by the numeral 1, is shown attached at its lower end to a pedal 2 attached to a conventional shaft 2A of stationary bicycle 3 and at its upper end strapped to the thigh stump 4 of the amputee 5.

Figure 2:
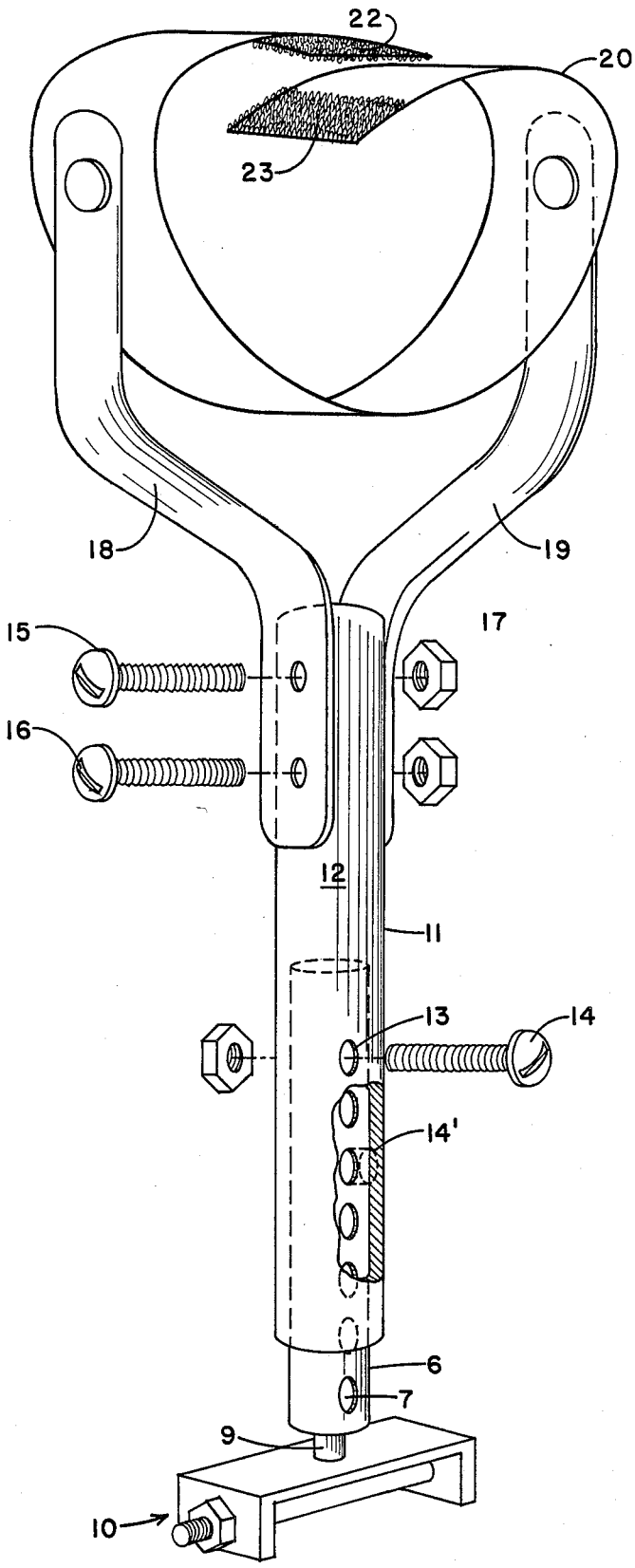
FIG. 2 is a three-fourths perspective view of a preferred embodiment of the invention.

In one preferred embodiment shown in FIG. 2 the cyclist aid comprises shaft 6 having a series of openings 7 extending along its vertical axis. At the lower end 8 of shaft 6 is a conventional rotational assembly 9 that connects shaft 6 to bracket assembly 10 in a manner to allow bracket 10 to rotate about the vertical axis of shaft 6. In a preferred embodiment lower end 8 has ridge sections 8A and 8B extending into the cavity 6A of shaft 6 to form a groove that rotating head 9A affixed to shaft 9B fits in a manner to prevent vertical movement of rotating head 9A. Fitting over shaft 6 is tubular member 11 having a center hollow cavity 12 into which shaft 6 can slide vertically. Tubular member 11 is provided with an opening 13 which can be aligned with one of openings 7 to allow bolt 14 to pass to fix the position of shaft 6 and tubular member 11 relative to one another. By adjusting which aligned openings snap spring lock 14 passes the overall length of cyclist aid 1 can be changed.

In an alternate embodiment shown by dotted lines in FIG. 2 a conventional snap spring lock 14' can be used in place of bolt 14 to fix shaft 6 in position to tubular member 11.

Figure 3:
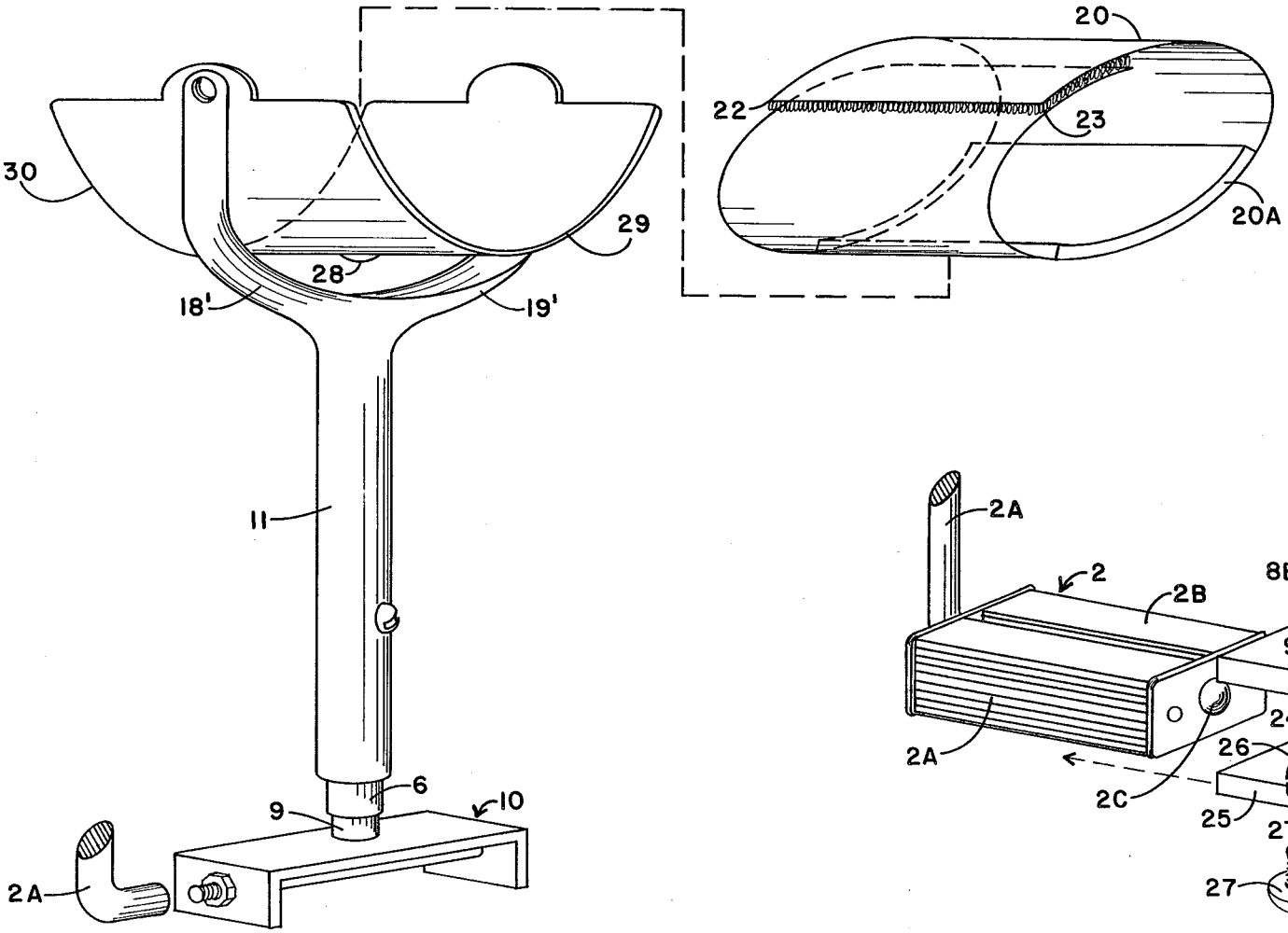
FIG. 3 is a three-fourths perspective view of a second preferred embodiment of the invention having a arcuate, concave support brace on which the thigh stump can rest.

Attached by bolts 15 and 16 to the upper end 17 of member 11 are two separated support members 18 and 19 that extend upward from upper end 17. In a preferred embodiment support members 18 and 19 are sufficiently rigid so as not to bend inward toward one another during the pedalling operation as described below. In an alternate embodiment shown in FIG. 3 member 11 is one piece having separated support members 18' and 19' extending therefrom instead of having support members 18 and 19 bolted thereto as shown. A flexible strap 20 is pivotly attached at the upper ends of each support member 18 and 19 to form a cradle in which the thigh stump can rest. Strap 20 is preferrably wide enough so as not to cut into the thigh stump 4. Suitable material for said strap includes plastic, but is more preferably a fabric that will not cause the thigh stump to perspire during the cycling exercise. In a more preferred embodiment shown in FIG. 3 a rigid stump rest 21 having an arcuate concave surface for the thigh stump 4 to rest is pivotly attached to support members 18 and 19. In this embodiment strap 20 is fixedly attached to stump rest 21 by rivets 28. In either embodiment strap 20 is sufficiently long to wrap about thigh stump 4. In a more preferred embodiment rivet 28 is prevented by padding 20A from contacting stump 4.

VELCRO (hook-and-pile fasteners) strips 22 and 23 are glued or otherwise fixed to the ends of strap 20 so as to be operatively opposed to one another when strap 20 has been wrapped firmly against thigh stump 4 so as to hold strap 20 enclosed about thigh stump 4.

Figure 4:
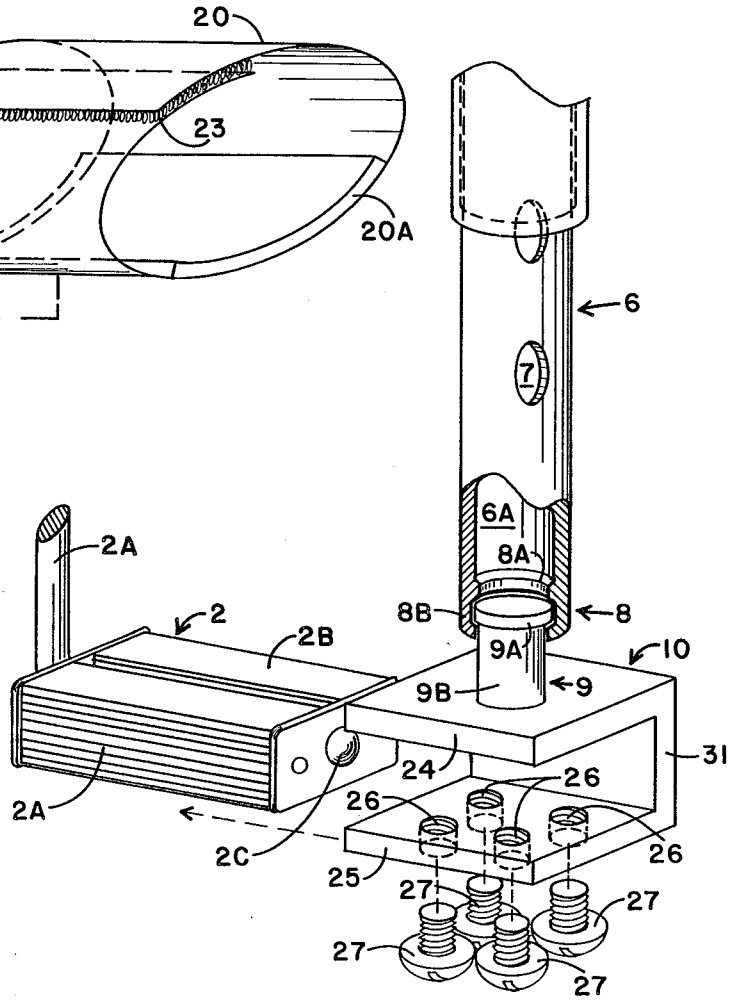
FIG. 4 is a three-fourths perspective view of a preferred embodiment of the means for attaching the shaft to the pedal of the bicycle.

In a preferred embodiment shown in FIG. 4 bracket assembly 10 is designed to be quickly attachable to pedal 2. In this preferred embodiment bracket assembly 10 comprises a U-shaped metal bracket formed by upper plate 24 and lower plate 25 held parallel to one another by vertical plate wall 31 a sufficient distance apart to fit about pedal 2 as shown. Lower plate 25 is provided with one or more threaded openings 26 for screws 27 to be screwed upward fixing bracket assembly 10 to pedal 2. Preferably threaded openings are positioned so screws 27 contact the rubber or plastic portions 2A and 2B of pedal 2 rather than axle 2C.

Now in operation the bicycling aid 1 is attached to pedal 2 by screws 27 being screwed upward. The amputee then mounts the stationary bicycle and places the thigh stump 4 on the strap 20 which is then wrapped round the thigh stump 4 and fastened by pressing the VELCRO strips against one another. The amputee then begins pedalling in normal fashion.

There are of course many alternate embodiments of specific features of this invention, such by way of example only would include the use of a buckling assembly to tighten strap 20 about the thigh stump, permanently mounting the bracket assembly 10 to pedal 2 by welding, etc. all of which fall within the scope of this invention, and which are intended to be included within the description of the invention.

What I claim is:

1. An apparatus for use by a leg amputee having only a thigh stump to ride an exercise or a conventional bicycle having foot pedals to operate said bicycle, which comprises:

(a) shaft having pedal attachment means rotatably connected at a lower end of said shaft to attach to one of said foot pedals of said bicycle and having separated support members attached to its upper end in a position to extend upward from said upper end, said pedal attachment means comprising bracket means for attaching to said pedal to permit rotation of said attachment means about the axle of said pedal, (b) a flexible thigh stump support means pivotly attached to each of said support members, and being of a length sufficient to wrap around said thigh stump, and (c) fastening means attached to the ends of said thigh stump support means to operatively hold said flexible thigh stump support means firmly against said thigh stump.

2. an apparatus according to claim 1 wherein said shaft comprises a hollow first tube member and a second tube member sized to telescope into and out of said first tube member, and wherein a locking means attached to said first tube member operatively contacts said second tube member to fixedly position said second tube member to said first tube member.

3. An apparatus according to claim 2 wherein said first tube member has extending outward from its vertical surface a snap spring lock to operatively engage one of a series of openings in said tube member.

4. An apparatus according to claim 2 wherein:

(a) said first tube member is provided with a series of openings extending through said first tube member and positioned vertically on said first tube member, (b) wherein said second tube member is provided with a like series of openings extending through said second tube member and positioned vertically on said second tube member so as to be alignable with said series of openings in said first tube member, and (c) a pin means sized to pass through both series of aligned openings in said first and second tube members to fixedly position said first tube member to said second tube member.

5. An apparatus according to claim 1 wherein:

(a) said first tube member is provided with a series of openings extending through the wall of said first tube member and positioned vertically on said first tube member, (b) a snap spring lock having a locking stub is attached to said second tube member said locking stub being positioned and sized to pass through at least one of said openings.

6. An apparatus according to claim 1 wherein said fastening means are VELCRO strips positioned on said flexible member to operatively contact one another when said flexible member is wrapped about said thigh stump.

7. An apparatus according to claim 1 wherein an arcuate shaped member having its convex shaped surface facing downward is pivotly attached to and between said separated support members in a position allowing said flexible thigh stump support means to rest on the concave shaped surface of said arcuate shaped member.

8. An apparatus according to claim 7 wherein said arcuate shaped member is sized and positioned relative to said flexible thigh stump support means to allow said flexible thigh stump support means to extend past the sides of said arcuate shaped member.

9. An apparatus according to claim 7 or 8 wherein said arcuate shaped member is rigid.

10. An apparatus for use by a leg amputee having only a thigh stump in riding a bicycle being operatively driven by pedals, which comprises:

(a) a shaft having a series of openings positioned along its vertical axis, (b) bracket means rotatably attached to the lower end of said shaft to allow rotation about the longitudinal axis of said shaft, said means clampingly attached to one of said pedals, for permitting rotation of said attachment means about the axle of said pedal, (c) a tubular shaft having a center cavity sized to allow said shaft to slide in said center cavity, said tubular shaft being provided with an opening positioned to align with one of the openings of said shaft, (d) attaching means sized to pass through the aligned openings of said shaft and said tubular shaft to fix said shaft to said tubular shaft, (e) separated members attached to and extending upward from said tubular shaft, (f) rigid brace means pivotly attached to said separated support means and having an arcuate concave surface to which is attached a flexible thigh stump strap having means to tighten said strap about said thigh stump placed on said strap in said rigid brace means.

11. An apparatus according to claim 10 wherein said bracket means comprises upper and lower plates connected by a vertical plate to hold said upper and lower plates in parallel position to one another and separated a distance sufficient to fit about said pedal, said lower plate having a threaded opening to receive a screw which when screwed upward contacts said pedal to fix said means to said pedal.

* * * * *